United States Patent [19]

Reese et al.

[11] 4,267,502

[45] May 12, 1981

[54] PRECIPITATOR VOLTAGE CONTROL SYSTEM

[75] Inventors: Robert O. Reese, Lancaster; Karl R. Wieber, Middletown; James T. Hartman, Reading, all of Pa.

[73] Assignee: Envirotech Corporation, Menlo Park, Calif.

[21] Appl. No.: 41,965

[22] Filed: May 23, 1979

[51] Int. Cl.[3] ..... B03C 3/68

[52] U.S. Cl. ..... 323/237; 323/320; 323/903; 55/105

[58] Field of Search ..... 323/9, 18, 20, 22 SC, 323/24, 34; 55/104, 105; 361/89, 94-97

[56] References Cited

U.S. PATENT DOCUMENTS

| | | | |
|---|---|---|---|
| 3,577,708 | 5/1971 | Drenning | 323/34 |
| 3,745,749 | 7/1973 | Gelfand | 323/9 X |
| 3,772,853 | 11/1973 | Burge et al. | 55/105 |
| 3,873,282 | 3/1975 | Finch | 55/105 |
| 3,877,896 | 4/1975 | Muskovac | 55/105 |
| 4,152,124 | 5/1979 | Davis | 55/105 |

*Primary Examiner*—William M. Shoop
*Assistant Examiner*—Peter S. Wong
*Attorney, Agent, or Firm*—Robert E. Krebs; Hal J. Bohner

[57] ABSTRACT

An improved precipitator voltage control system including an automatic voltage control (AVC) circuit, a firing circuit, an alarm circuit, a power-saving circuit, a remote set-point control circuit and a power supply, all of which are mounted on a single, readily interchangeable circuit board. The automatic voltage control circuit includes a highly responsive spark detection subcircuit which causes the transformer/rectifier voltage to be reduced to zero at the end of the half-cycle in which a spark occurs and then causes the voltage to remain at zero for a short period of time after which voltage is reapplied in a dual ramp manner causing it to rapidly reach a level below the precipitator arcing potential and then increase at a slower rate to the threshold of sparking. The firing circuit drives silicon-controlled rectifiers (SCRs) through optical couplers which provide several thousand volts of circuit isolation. The alarm circuit detects short-circuit and open-circuit conditions and causes automatic trip-out of the control circuit when such alarm conditions exist. The power-saving circuit allows operation of the precipitator to be monitored and the voltage thereof to be reduced during high resistivity conditions. The remote set-point control allows the drive current to be controlled from a remote source.

12 Claims, 9 Drawing Figures

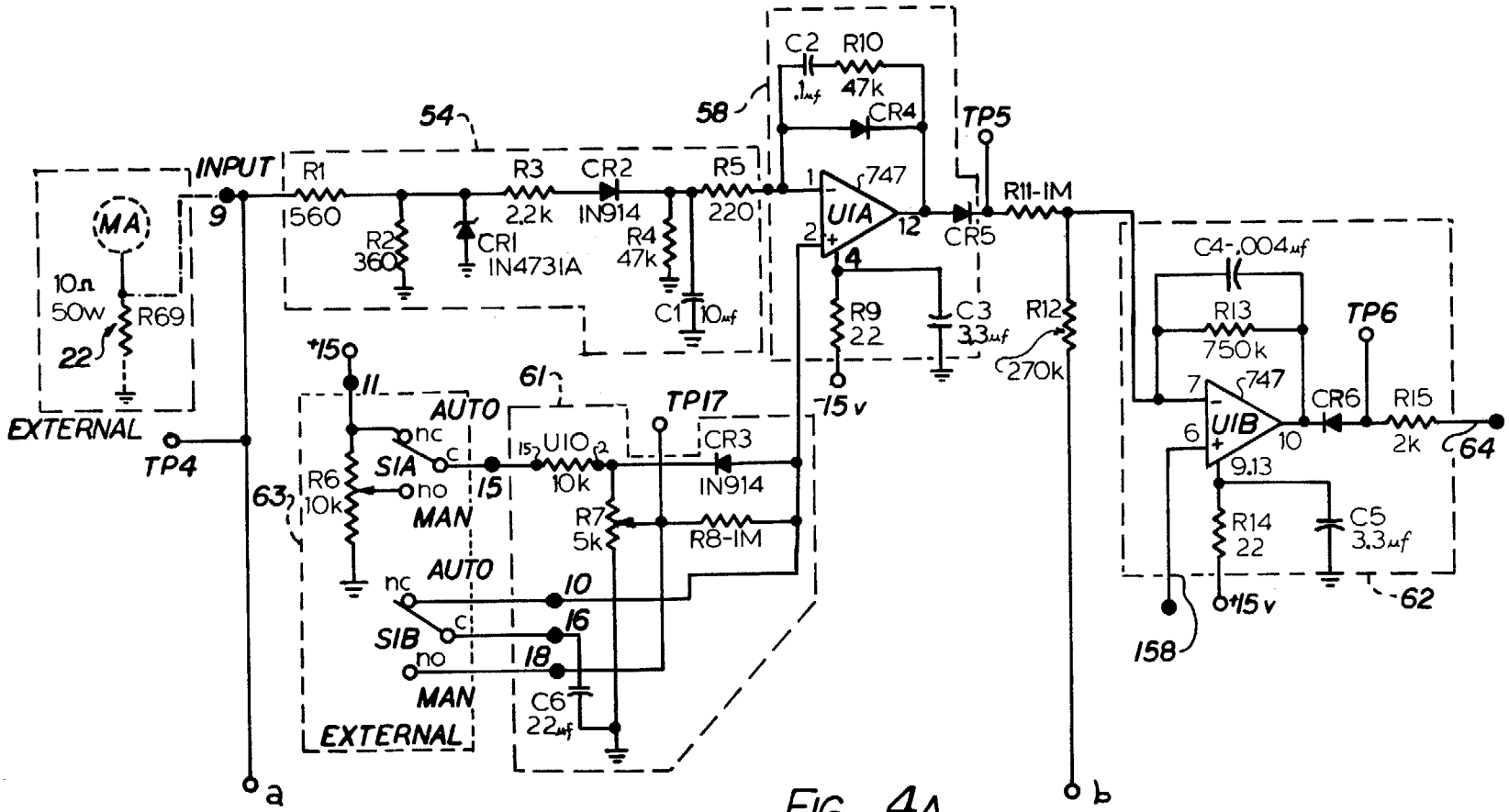
FIG. 4A1

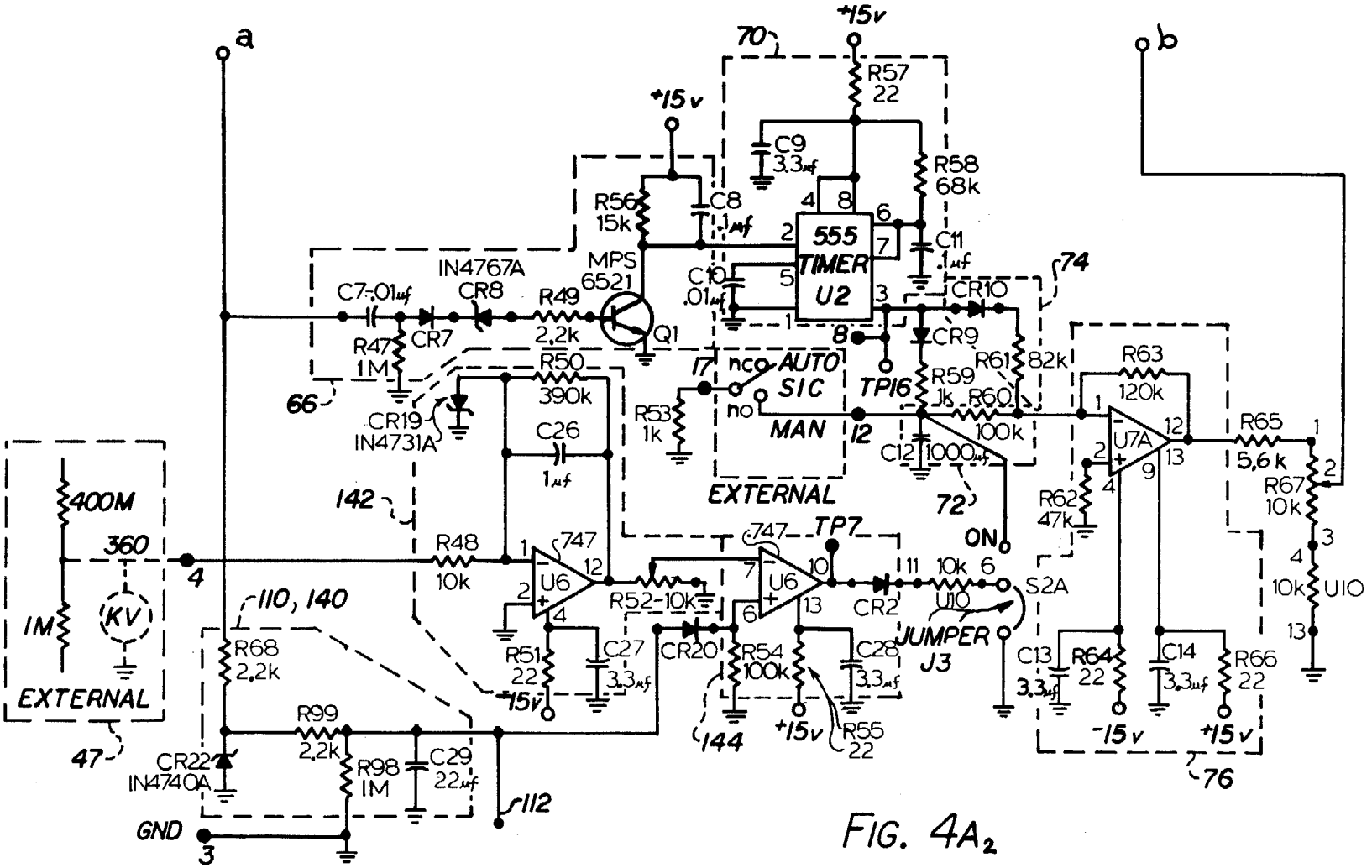
FIG. 4A2

PRECIPITATOR VOLTAGE CONTROL SYSTEM

BACKGROUND OF THE INVENTION

1. Field of the Invention

The present invention relates generally to electrostatic precipitator apparatus and more particularly to an automatic voltage control and SCR firing circuit for use in such apparatus to instantaneously cut off power when sparking occurs and then rapidly return the precipitator voltage to a subsparking level and gradually increase from the subsparking level to the sparking threshold.

2. Description of the Prior Art

Electrostatic precipitators and control circuits therefor are well kwown in the prior art. A typical modern version of such device and its control circuitry is generally illustrated in FIG. 1 and includes a pair of input terminals 10 across which is impressed a line voltage, a step-up transformer 12, a choke 14, a pair of SCR switches 16 and 18, and a full wave rectifier 20. One output terminal of the rectifier 20 is connected to circuit ground through the resistive element of a low resistance potentiometer 22 and the other output terminal is connected to the emitting electrodes 24 of a precipitator illustrated schematically at 26. The collecting electrode 28 of precipitator 26 is connected to circuit ground.

The firing times of the SCRs 16 and 18 are controlled by an automatic voltage control and SCR firing circuit 30 which detects sparking as a function of the transformer secondary current feedback signal obtained from the tap 32 of potentiometer 22. A prior art embodiment of a similar circuit is disclosed in the U.S. patent to Peter Gelfand, U.S. Pat. No. 3,745,749. Although circuits such as that disclosed in the Gelfand patent function well, they are relatively large in size and are relatively slow in operation due to the use of magnetic firing circuits.

SUMMARY OF THE PRESENT INVENTION

It is therefore a primary object of the present invention to provide an improved electronic voltage control and firing circuit for electrostatic precipitators which is simple in configuration, small in size, reliable in operation, and easy to maintain.

Briefly, a preferred embodiment of the present invention includes an automatic voltage control (AVC) circuit, a firing circuit, an alarm circuit, a power-saving circuit, a remote set-point circuit and a power supply, all of which are mounted on a single, readily interchangeable circuit board. The automatic voltage control circuit includes a highly responsive spark detection subcircuit which causes the transformer/rectifier voltage to be reduced to zero at the end of the half-cycle in which a spark occurs. The circuit then causes the rectifier voltage to remain at zero for a short period of time after which voltage is reapplied thereto in a dual ramp manner, causing it to rapidly reach a level below the precipitator arcing potential and then increase at a slower rate to the threshold of sparking. The firing circuit drives silicon-controlled rectifiers (SCRs) through optical couplers which provide several thousand volts of circuit isolation. The alarm circuit detects short-circuit and open-circuit conditions and causes automatic trip-out of the control circuit when such alarm conditions exist. The power-saving circuit allows the precipitator to be monitored and the voltage thereof to be reduced during high resistivity conditions. The remote set-point control allows the drive current to be controlled from a remote source.

Among the many advantages of the present invention is that it instantaneously cuts off power when sparking occurs and then after the shortest possible off-time reapplies the power rapidly to a subsparking level followed by a gradual increase from the subsparking level to the sparking threshold.

Another advantage of the present invention is that it is small in size, relatively inexpensive and easy to maintain.

Still another advantage of the present invention is that it includes means for enabling remote set-point adjustment.

These and other advantages of the present invention will no doubt become apparent to those of ordinary skill in the art after having read the following detailed description of the preferred embodiment which is illustrated in the several figures of the drawing.

IN THE DRAWING

FIGS. 4A–4C are collectively a detailed schematic circuit of the block diagram illustrated in FIG. 2.

DETAILED DESCRIPTION OF THE PREFERRED EMBODIMENT

Figure 2:
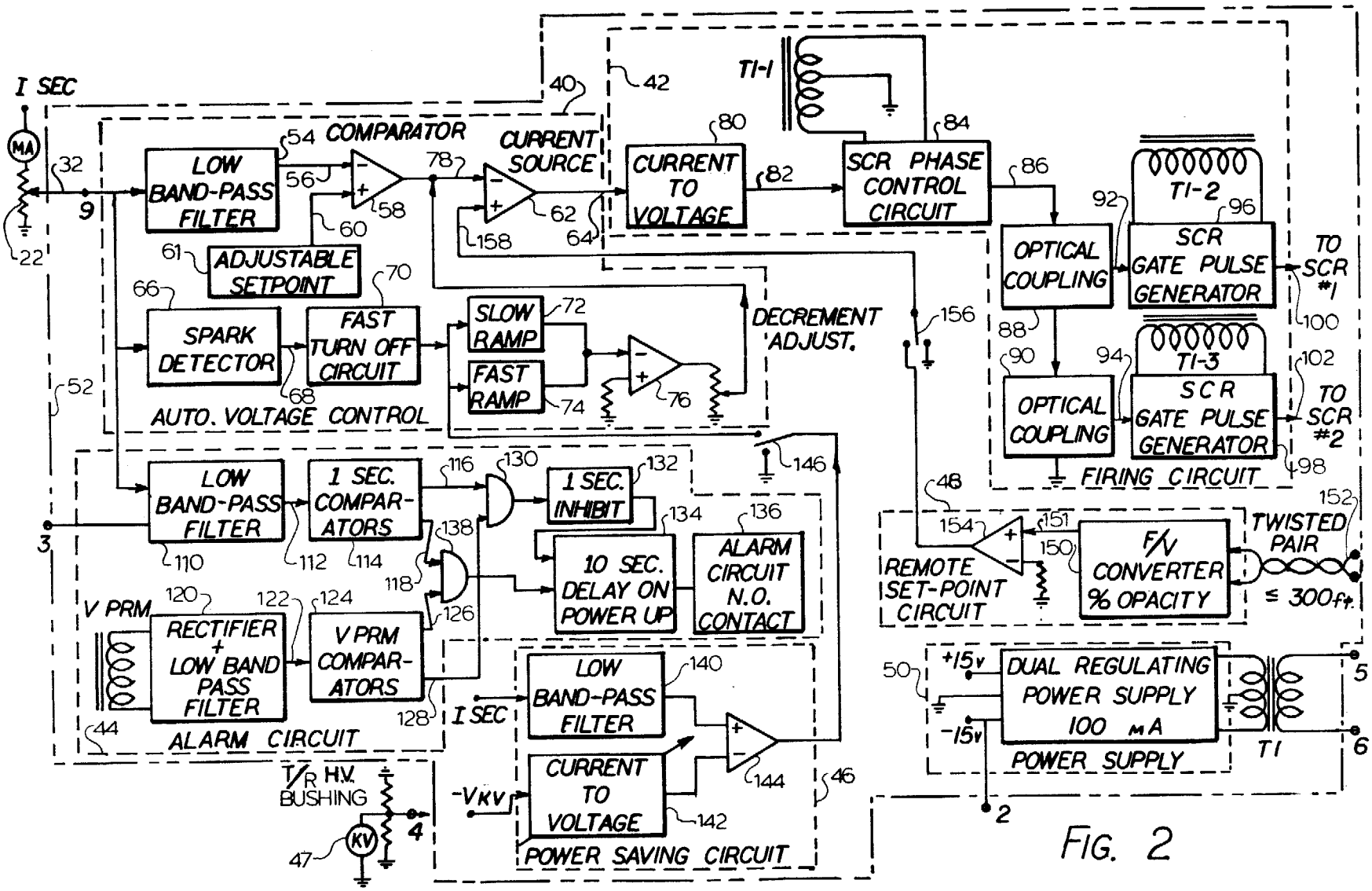
FIG. 2 is a block diagram schematically illustrating an automatic voltage control and SCR firing circuit in accordance with the present invention.

Referring now to FIG. 2 of the drawing, there is shown a block diagram of a preferred embodiment of the present invention including an automatic voltage circuit 40, a firing circuit 42, an alarm circuit 44, a power-saving circuit 46, a remote set-point circuit 48, and a power supply 50. All of these elements are contained on a single circuit board 52 which has been designated to be compact, easily accessible, and easily maintained. The circuit board 52 includes a standard edge-connecting means (not shown) which plugs directly into a prewired edge connector; it uses light-emitting diodes to provide guidance for the operator in servicing the alarms; it contains test point terminals for attaching oscilloscope probes; and it contains DIP sockets for easy installation of integrated circuits. Furthermore, the board 52 is provided with individual SCR gate and cathode leads using polarized plugs.

The AVC circuit 40 includes a low-pass filter 54 which receives the secondary current feedback signal developed at the tap 32 of the potentiometer 22, filters it and develops a positive dc potential on line 56 proportional to the actual feedback current. The comparator 58 compares the feedback potential to an adjustable set point reference voltage input at 60 which establishes a maximum allowable secondary current. Such maximum secondary current is typically listed on the transformer/rectifier name plate. In the absence of a spark condition, the output of comparator 58 will be input to a current source 62 to produce a constant output drive current at 64 proportional to the transformer positive secondary current feedback. However, when a spark occurs the spark detector 66 will detect transients in the feedback current which are indicative of the sparking condition and will develop an output signal on line 68 which triggers a fast turn-off circuit 70. Circuit 70 is configured as a monostable, multivibrator whose period is approximately 11 msec. The output of circuit 70 is fed through a slow ramp generating circuit 72 and a fast ramp generating circuit 74 to an inverting amplifier 76, the output of which is algebraically added to the comparator output signal on line 78. Since the output of circuit 70 is a positive-going pulse of approximately 11 msec. duration, the signal developed at the output of the inverting amplifier 76 will be a negative-going pulse, the trailing edge of which increases toward zero potential at a rate determined by the fast ramp circuit 74 and until it reaches a predetermined voltage below zero, at which time it transitions toward zero at a slow rate determined by the slow ramp circuit 72. This signal is then algebraically added to the feedback signal on line 78 and causes the current source 62 to sharply transition from the feedback signal level to zero and remain at zero for approximately 11 to 12 msec., then ramp back toward the feedback level at a fast rate followed by a slower rate corresponding to the time constant of slow ramp circuit 72.

The firing circuit 42 is comprised of a current-to-voltage converter 80 which generates a voltage on line 82 corresponding to the current input thereto on line 64, an SCR phase control circuit 84 which compares the voltage on line 82 to a sawtooth reference and generates a pulse width modulated chain of output pulses on line 86 that are in phase with the transformer voltage, a pair of optical coupling circuits 88 and 90 which develop voltage-isolated signals on lines 92 and 94, respectively, and a pair of SCR gate pulse generators 96 and 98 which respond to the isolated signals and develop SCR firing pulses on lines 100 and 102, respectively.

The alarm circuit 44 includes a low band-pass filter 110 which develops a signal on line 112 proportional to the secondary current Isec and a set of comparators 114 which, as will be explained in more detail below, compare the feedback signal on line 112 to preset references and develop signals on line 116 and 118 depending upon the relationship of the feedback signal to the references. The circuit also includes a rectifier and low band-pass filter 120 which are electrically coupled to the primary of the power transformer and develop a signal on line 122 which is input to a set of comparators 124 that compare the signal to preset references and develop outputs on lines 126 and 128 depending upon the relationship between the input signal and the references. More specifically, the output signals developed by comparators 114 and 124 will indicate detection of a short circuit and/or open circuit condition in the power transformer.

The signals developed on lines 116 and 128 are input to an AND gate 130 and the output thereof is input to an inhibit circuit 132 which will inhibit the signal for approximately 1 second before it is input to the alarm 136 and thereby avoid unnecessary transformer trip-out. The outputs developed on lines 118 and 126 are input to an AND gate 138. On initial start-up, the power-up delay unit 134 will delay an alarm signal received from inhibit circuit 132 and AND gate 138 for approximately 8 to 10 seconds. This allows ample time for the circuitry used in the system to stabilize after initial power-up. It will thus be appreciated that this alarm circuit constantly monitors the transformer primary voltage and secondary current and uses these inputs to develop an alarm in the event of either a short circuit or an open circuit in the transformer secondary.

Figure 3:
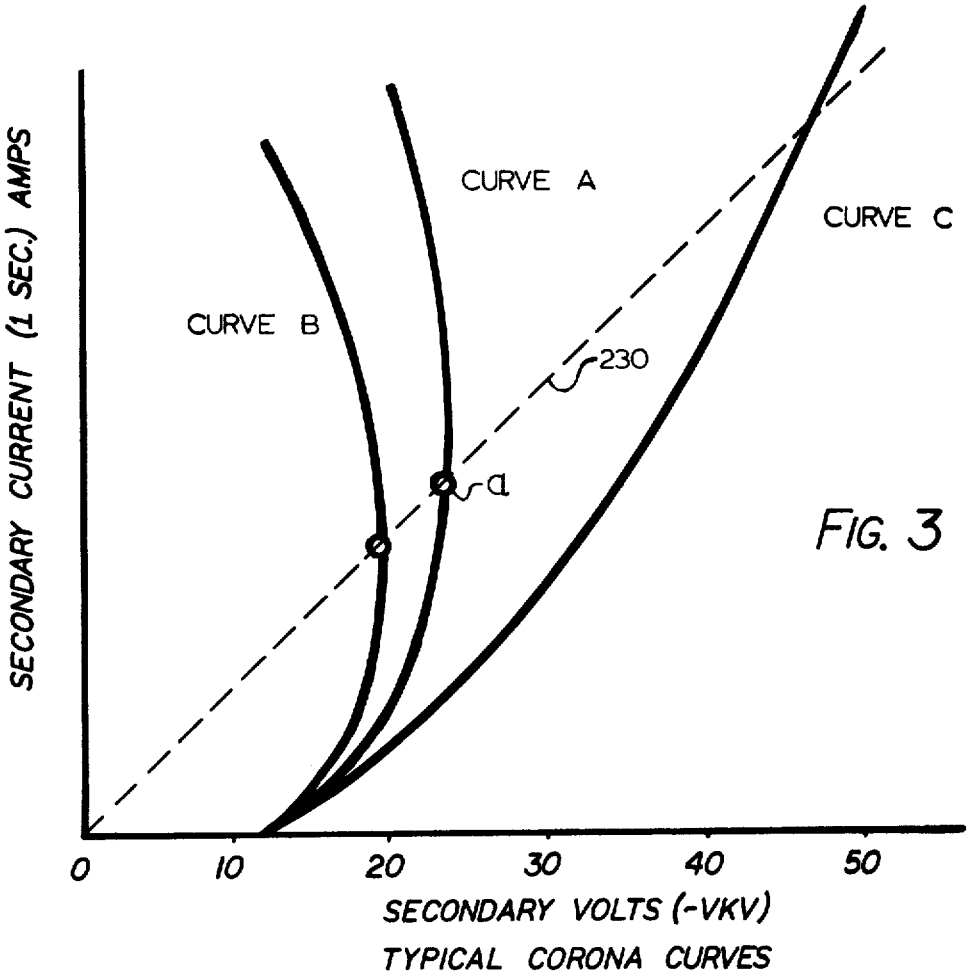
FIG. 3 is a diagram illustrating typical corona curves in an electrostatic precipitator.

The power-saving circuit 46 is intended to reduce the power applied to the precipitator while maintaining maximum precipitator performance and is primarily intended for high resistivity applications. As indicated in FIG. 3 of the drawing, the transformer secondary current and secondary voltage have a nonlinear relationship. Initially, at very low voltage the precipitator draws very low current, but as the voltage increases, corona will be generated which will start increasing conduction and cause considerable amounts of current to be drawn. At this time, the secondary current rises much more rapidly than the voltage, and under certain conditions the voltage can even decrease with a rise in current, as indicated by curves A and B. This means that for increases in current there will not be a proportional increase in precipitator performance.

The power-saving circuit 46 is thus intended to take an appropriately scaled feedback voltage signal from the secondary circuit, as provided by the external circuit 47, and compare it directly with an appropriately scaled secondary current signal. In the event that the scaled secondary current exceeds the scaled feedback voltage, the comparator 144 will develop an output which when fed into the automatic voltage control circuit 40, via an appropriate jumper or switch 146, will cause the operating power level to be backed down to a point where the scaled current and voltage signals are equal. Note also that the scaling of the output developed by the converter 142 is adjustable so that the precipitator can be operated at a lower current without sacrificing voltage. The theory behind this is that by appropriately reducing the power consumed by the precipitator, a considerable savings will be obtained without any considerable loss of collection efficiency.

Another feature of the present invention is the remote set-point circuit 48 which includes a frequency-to-voltage converter 150 that develops a voltage on line 151 which is proportional to the input frequency of a signal input on lines 152. The voltage is then buffered by an amplifier 154 and input via an appropriate jumper or switch 156 to the positive input 158 of the current source of amplifier 62. Using this circuit, a remote input signal from a function generator, or a monitor circuit capable of generating a frequency proportional to percentage opacity, may be used to operate the AVC at or below the threshold of sparking. For example, in the event of a boiler upset where the boiler flame is lost, there would be combustible gases going through the precipitator. If there were significant amounts of oxygen and heat along with combustibles, a spark could cause ignition. In order to avoid this occurrence, the input to the remote set-point circuit could be connected to some portion of the boiler control circuit which indicates loss of boiler ignition. A resulting signal would immediately turn off the precipitator and prevent any unwanted ignition occurring therein. The circuit could also be used to accommodate a cold start-up. This is to say that the input to the remote set-point circuit could be coupled to an appropriate temperature gauge means which could generate a signal for input to circuit 48 to cause the precipitator to be turned off during the start-up procedure so that it does not collect moisture contained in the boiler effluent. Numerous other uses could also be made of the circuit 48.

The power supply 50 is a standard dual regulating power supply having one primary winding T1 and three secondary windings T1-1, T1-2 and T1-3. The first secondary winding T1-1 is used to provide a phase determining input to SCR phase control circuit 84 while the other two secondary windings T1-2 and T1-3 are used solely for interfacing with the high voltage, high current SCRs. The power supply also develops regulated plus and minus 15-volt outputs for powering the various circuit elements previously described.

Figure 4B:
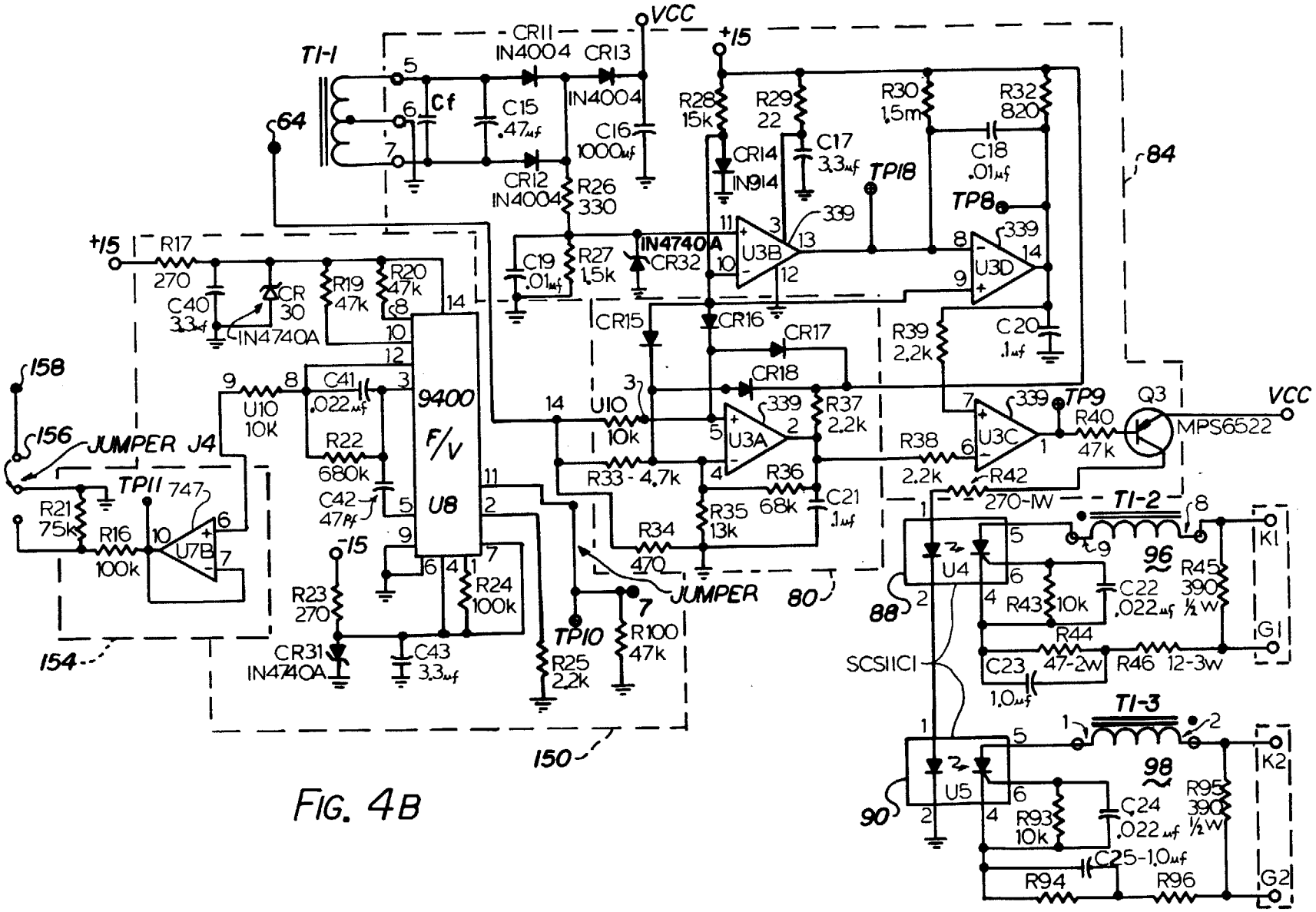
Figure 4C:
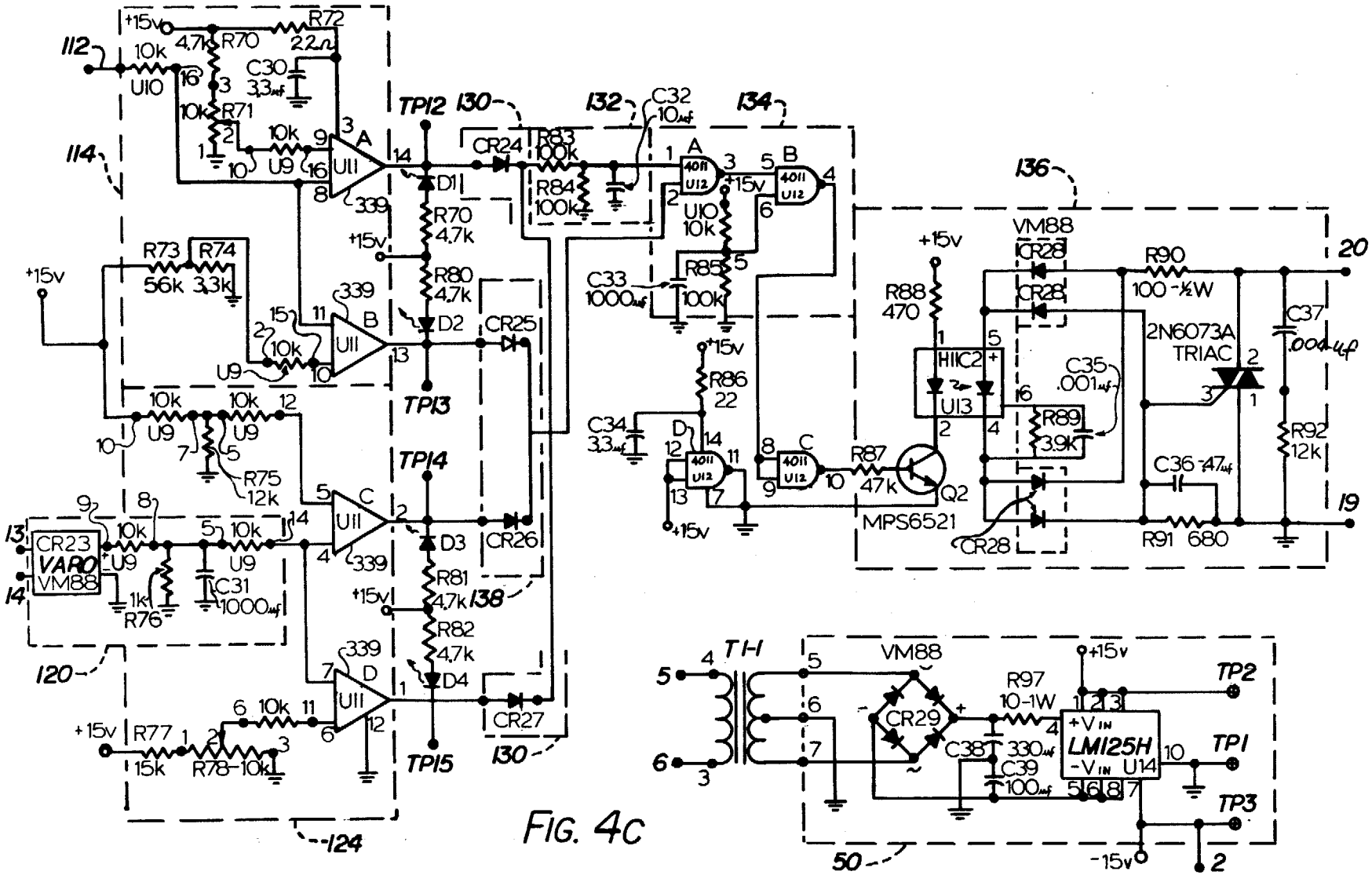
Figure 5:
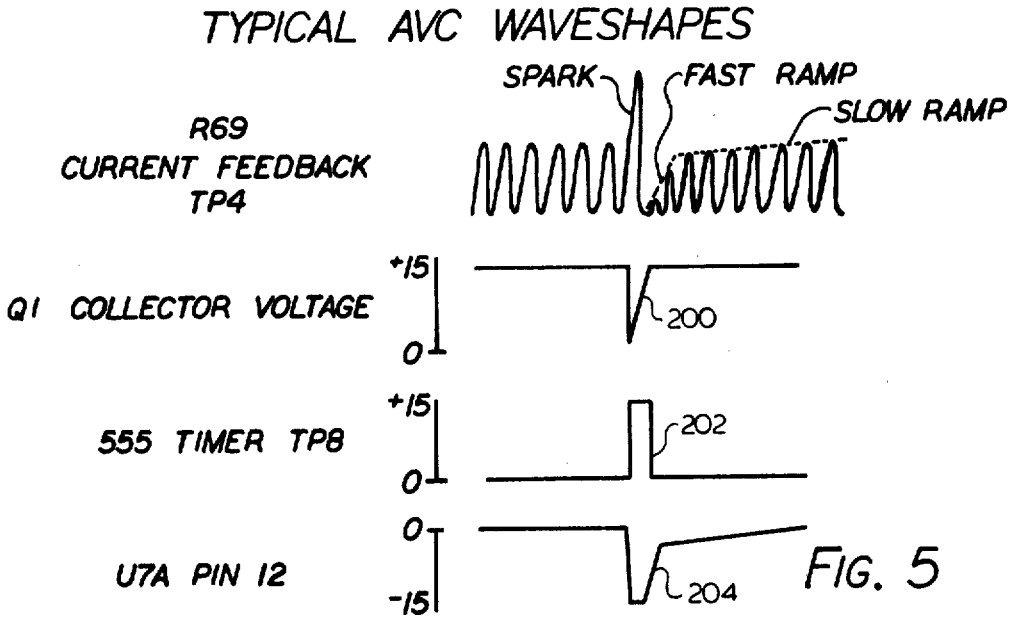
FIG. 5 is a timing diagram showing typical AVC waveshapes.

Turning now to FIGS. 4A, 4B and 4C, which is a detailed schematic of the circuit represented in block diagram form in FIG. 2, and FIGS. 5 and 6 which show typical AVC and thyristor control waveshapes, operation of the preferred embodiment will be described making reference to various circuit components. In FIG. 4A the components of the AVC circuit and power-saving circuit are illustrated and segregated by dashed lines to correspond to the elements of the block diagram of FIG. 3. Under steady state conditions, AVC circuit 40 produces a constant output drive current at 64 proportional to the transformer/rectifier positive secondary current feedback input at terminal 9. The current feedback applied at terminal 9 is filtered by circuit 54 to provide a positive dc potential at 56 proportional to the actual feedback current. This signal is compared to a reference voltage applied at 60 and selected to establish a maximum secondary circuit. The maximum allowable secondary current is listed on the transformer/rectifier name plate.

Upon initial start-up, the voltage across capacitor C6 of the set-point circuit 61 is zero. The capacitor exponentially charges up to a maximum potential in approximately 20 seconds. This potential can be varied by adjusting potentiometer R7; thereby setting the maximum secondary current. With R7 turned fully clockwise, the maximum voltage across C6 is approximately 5.25 volts.

The resultant net turn-on voltage measured at PIN 12 of U1A is inverted and can be measured at TP6 as a negative voltage. Resistor R15 provides a negative drive current to the firing circuit 42. Transient conditions (sparks) are detected at the base of transistor Q1 of the spark detector circuit 66. (See FIG. 5 for typical AVC waveshapes.) The base network of transistor Q1 is AC coupled via capacitor C7 to the secondary current feedback applied at terminal 9. Under steady state conditions, the base impedance to Q1 is high, which does not allow sufficient base current to cause saturation. High frequency signals (sparks) cause the base impedance to go low, as indicated at 200 in FIG. 5, allowing the transistor to saturate. The collector of Q1 is normally high and goes low during saturation. When Q1 saturates fast turn-off circuit 70 triggers. The principal component of circuit 70 is a 555 timer U2 configured as a monostable multivibrator whose period is approximately 11 msec. The positive-going output pulse 202 (FIG. 5) generated thereby charges capacitor C12. The discharge time period of C12 is approximately 100 seconds. The one-shot pulse 202 also appears at PIN 1 of U7A via diode CR10 and an 82K input resistor R61. The output of U7A (PIN 12) is illustrated at 204 in FIG. 5 and is the proportional inverted summation of the potential across C12 and the potential of the 555 timer output pulse, and is algebraically added with the output of U1A PIN 12. At the occurrence of a spark, the voltage at TP 6 goes to zero for approximately 12 msec. At the end of this period, the negative voltage increases and will tend toward the steady state value maintained prior to sparking, minus the proportional voltage across capacitor C12. As the potential across capacitor C12 decreases, the voltage at TP 6 becomes more negative. The voltage at TP 6 may attain approximately −13 VDC.

Figure 6:
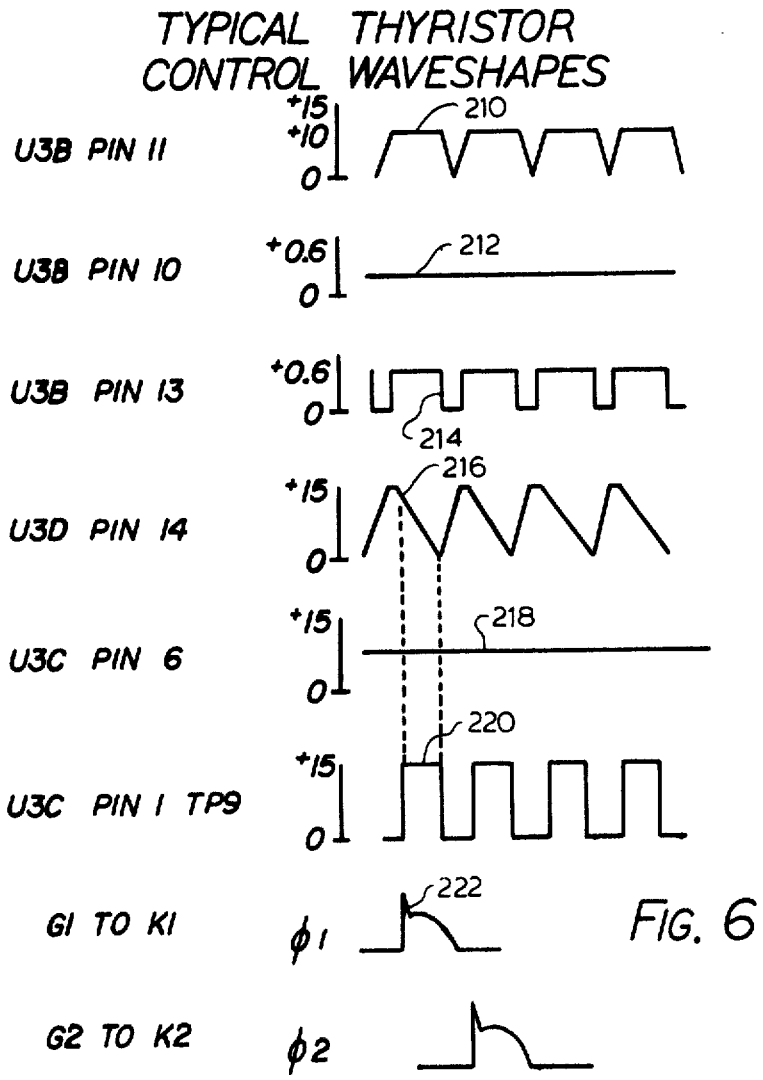
FIG. 6 is a timing diagram showing typical thyristor control waveshapes.

The SCR firing circuit 42 and remote set-point circuit 48 are shown in FIG. 4B and typical thyristor control waveshapes are illustrated in FIG. 6. A zero crossing detector portion of the pulse control circuit 84 consists of a full wave rectifier (CR 11 and CR 12), voltage divider (R26 and R27), a precision voltage divider (R28 and CR 14), and a comparator U3B. The input to PIN 11 of U3B is a full wave rectified sine wave 210 (see FIG. 6) of the same phase as the transformer rectifier voltage. This voltage is compared to the precision dc reference voltage 212 (FIG. 6) developed at PIN 10. The output of the comparator (PIN 13) goes low as indicated at 214 when the voltage on PIN 11 is less than that on PIN 10 (at zero crossing). This output is used to reset the ramp 216 generated at TP 8.

The ramp generating portion of circuit 84 consists of resistors R30 and R32, plus capacitor C18. R32 is a pull-up resistor which allows the ramp to be reset to VCC after each reset pulse. The slope of the ramp is determined by R30 and C18. U3A is a comparator configured to serve as the current-to-voltage converter 80 and develops a voltage at PIN 2 which is proportional to the drive current. Diodes CR15 and CR16 allow the circuit to accept both positive and negative drive currents. U3C is a comparator which compares the ramp developed at TP 8 to the voltage 218 developed by comparator U3A at PIN 2. The output waveform 220 is normally high and goes low when the voltage on PIN 6 is greater than the ramp voltage on PIN 7.

Figure 1:
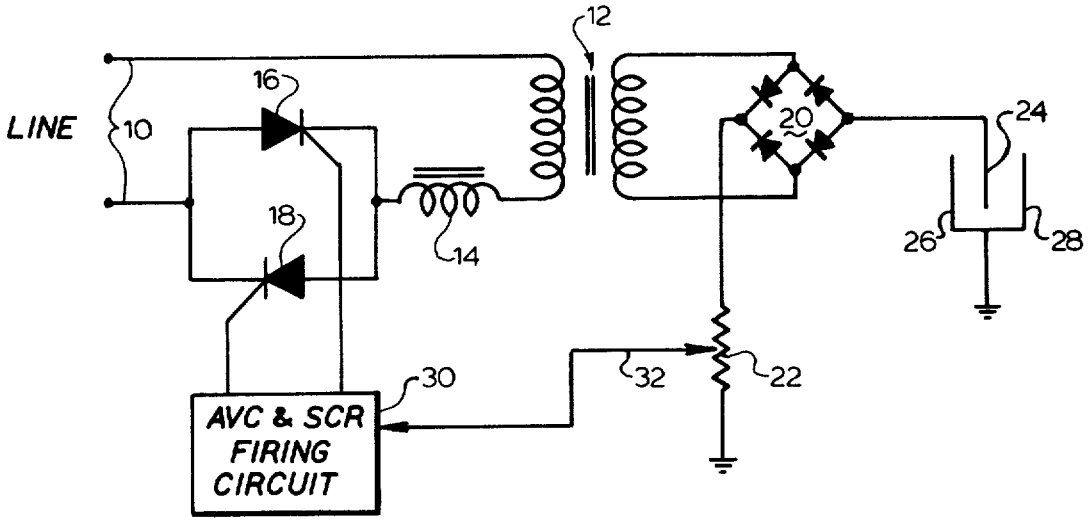
FIG. 1 is a schematic diagram generally illustrating a precipitator and its power supply circuitry as known in the prior art.

Transistor Q3 saturates when the output of comparator U3C is low. This allows current to flow through the photo-SCRs 88 and 90. Both SCR gate drive circuits are identical except for a 180° phase shift. Each photo-SCR gates current pulses to one of the precipitator antiparallel SCR gates shown in FIG. 1. The secondary windings of transformer T1 (labeled T1-2 and T1-3) are referenced to the cathodes of the respective SCRs. For example, when activated, the photo SCR 88 allows a current pulse to flow through resistors R44 and R46 of gate pulse generator 96 to the SCR gate via a plug J1. When the photo-SCR 88 is initially gated, the 1.0 MFD capacitor C23 is discharged, producing a current spike 220 necessary for good triggering of the SCR. Photo-SCR 90 and gate-pulse generator 98 function in similar fashion.

The alarm circuit 44 shown in detail in FIG. 4C constantly monitors the transformer primary voltage and secondary current Isec. The primary voltage is isolated and stepped down to a maximum of 117 VAC by an external transformer (not shown). This voltage is bridge rectified by CR23 and then filtered by R76 and C31. The filtered voltage is then applied to comparators U11C (PIN 4) and U11D (PIN 7) for comparison to reference voltages applied at PIN 5 and PIN 6 of the comparators.

During open circuits (high primary voltage), the voltage on PIN 4 exceeds that on PIN 5. The output (TP 14) thus goes low, sinking current via R81 and LED D3.

During short circuits (low primary voltage), the voltage on PIN 6 exceeds the voltage on PIN 7, and the output (TP 15) goes low.

Note that R78 can be adjusted to allow the operator to select the low voltage trip level.

The alarm circuit current monitor section including comparators U11A and U11B operates in a similar manner. High currents cause the voltage at Tp 12 to go low. Low currents cause the voltage at TP 13 to go low. R71 can be adjusted to select the desired high current trip level.

Diodes CR24 through CR27 are connected in an AND gate configuration; high current and low voltage logic levels are gated together. Similarly, high voltage and low current logic levels are gated together.

The short circuit alarm condition is delayed by circuit 132 for approximately 800 msec. and then gated into U12A. On initial start-up, short and open circuit trips are inhibited for approximately 8 seconds by circuit 134. This is accomplished by electrically holding PIN 6 of U12B low. When initially energized, the voltage on C33 is zero. The voltage thereafter increases exponentially to 13.6 volts. When a logic level 1 is reached, alarm trip conditions are gated through U12C which is configured as an inverter. Listed below are the truth tables for the three gates U12A, U12B and U12C mentioned above.

U12A

| PIN | 1 | 2 | 3 |
|---|---|---|---|
| | 0 | 0 | 1 |
| | 0 | 1 | 1 |
| | 1 | 0 | 1 |
| | 1 | 1 | 0 |

LOGIC 1 AT PIN 3 = ALARM TRIP

U12B

| PIN | 5 | 6 | 4 |
|---|---|---|---|
| | 0 | 0 | 1 |
| | 0 | 1 | 1 |
| | 1 | 0 | 1 |
| | 1 | 1 | 0 |

LOGIC 0 AT PIN 4 = ALARM TRIP

U12C

| PIN | 8 | 9 | 10 |
|---|---|---|---|
| | 0 | 0 | 1 |
| | 1 | 1 | 0 |

LOGIC 1 AT PIN 10 = ALARM TRIP

When the base of transistor Q2 is high, the transistor is in the saturation mode, allowing current to flow through U13 PIN 1 and PIN 2. When gated, the photo-SCR conducts producting gate pulses every 8.33 msec. The output PIN 19 and PIN 20 appear as normally open contacts. Upon loss of ac power to the AVC 40, the 2N6073A TRIAC will remain gated on for 50 msec.

The on-board low voltage dc power supply 50 is also shown in FIG. 4C. Its input terminals 5 and 6 are connected to a 120 VAC line. Transformer, T1-1, steps down the line voltage to approximately 20 VAC with respect to ground. The 20 volt supply is then rectified by CR29, filtered by the capacitors C38 and C39, and connected to a dual fixed +15 volt and −15 volt regulator LM125H. The series 10 ohm resistor R97 connected to the regulator is used for current limiting. Every integrated circuit connected to the power supply is decoupled via a 22 ohm resistor and 3.3 microfarad capacitor.

Referring now again to FIG. 4B, the detailed schematic of the remote set-point circuit will be discussed. A remote (500 ft. max.) input signal from a function generator, or a monitor circuit capable of generating a frequency proportional to percent opacity, may be coupled to the board edge connector at PIN 7 for input to the on-board frequency-to-voltage converter 150 which has been configured to generate a voltage proportional to input frequency in the range of 0.1 kHz to 10 kHz. The output voltage buffered by amplifier U7B can be measured at TP 11. When jumper 156 is in the ON position, the voltage at TP 6 can be controlled by the remote input port. As the input frequency of the remote control signal increases, the voltage at TP 6 tracks the control signal and ultimately reduces to zero. Should the input frequency to the 9400 ICU8 be removed, the AVC circuit will default to its normal operating mode.

The theory of operation of the power saving circuit illustrated at 140, 142 and 144 in FIG. 4A is the controlled reduction of power to the precipitator while maintaining maximum precipitator performance. The circuit is primarily intended for high resistivity applications.

The precipitator current ISEC obtained at the output of filter 140 and voltage −VKV, obtained via external circuitry 47, are electrically scaled in volts so that their maximum amplitudes are equal. These scaled voltages are then compared in an active comparator 144 (U6). When the amplitude of the measured current exceeds that of the precipitator voltage, a positive output voltage is generated at PIN 10 of U6 which can be used to cause both the compared voltage and current magnitudes to become equal as explained above.

Referring now again to FIG. 3, corona curve A is a typical high resistivity corona curve. With the energy conservation circuit enabled, i.e., with the jumper J3 (switch 146) in the ON position, the precipitator current will be reduced to the point "a" where the corona curve and comparator slope 230 intersect. Should it be desirable to operate at a lower point on the corona curve, R52 may be adjusted to change the scale of VKV (curve B). By continually adjusting R52, the power can be reduced to the point of corona onset.

Although the present invention has been described above in terms of a presently preferred embodiment, it is contemplated that alterations and modifications will become apparent to those skilled in the art after having read the above disclosure. It is therefore intended that the appended claims be interpreted as covering all such alterations and modifications as fall within the true spirit and scope of the invention.

What is claimed is:

1. An improved precipitator voltage control system responsive to a power transformer secondary current feedback signal and operative to control first and second antiparallel SCR switching devices in the transformer primary circuit comprising:

an automatic voltage control circuit including means for receiving said secondary current feedback signal and for developing a dc voltage signal corresponding thereto, means for monitoring said dc voltage signal to insure that it does not exceed a predetermined set-point level, means for converting said dc voltage signal to a corresponding drive current signal, detector means for monitoring said secondary current feedback signal and for developing a triggering signal when a spark condition is sensed, and means responsive to said triggering signal and operative to reduce said dc voltage signal to zero for a predetermined, relatively short period and then increase the magnitude of said dc voltage signal in a fast ramp mode to a level below said set-point level and thereafter increase said dc voltage in a slow ramp mode; and an SCR firing circuit including means for converting said drive current signal into a corresponding drive voltage signal, phase control circuit means for comparing said drive voltage signal to an oscillatory reference signal in phase with the secondary current of said power transformer and for developing a pulsewidth modulated signal commensurate therewith, optical isolator means responsive to said pulsewidth modulated signal and operative to develop first and second isolation signals, and first and second SCR gating means responsive to said first and second isolation signals and operative to develop first and second gating signals 180° out of phase with each other for input to said first and second antiparallel SCR switching devices.

2. An improved precipitator voltage control system as recited in claim 1 wherein said phase control circuit means includes a zero crossing detector circuit for developing a zero crossing signal in phase with the secondary current of said power transformer, a ramp generating means responsive to said zero crossing signal and operative to develop a sawtooth waveform, and comparator means for comparing said drive voltage signal to said sawtooth waveform to develop said pulsewidth modulated signal.

3. An improved precipitator voltage control system as recited in claim 1 wherein said means responsive to said triggering signal includes a one-shot monostable multivibrator for developing a turn-off pulse, a fast ramp circuit responsive to said turn-off pulse and operative to cause a first portion of the trailing edge of said turn-off pulse to decrease at a first rate, a slow ramp circuit responsive to said turn-off pulse and operative to cause a second portion of the trailing edge thereof to decrease at a second rate, and inverter means for inverting said turn-off pulse as modified by said fast ramp circuit and said slow ramp circuit and for algebraically adding the inverted signal to said dc voltage signal.

4. An improved precipitator voltage control system as recited in claims 1, 2 or 3 and further comprising:

alarm circuit means responsive to said secondary current feedback signal and a source transformer primary voltage signal and operative to actuate an alarm in the event of an open circuit or a short circuit in the secondary of said power transformer.

5. An improved precipitator voltage control system as recited in claim 4 wherein said alarm circuit means includes means for inhibiting the actuating of said alarm for a first predetermined period of time so as to prevent spurious transformer trip-out.

6. An improved precipitator voltage control system as recited in claim 5 wherein said alarm circuit means further includes means for delaying an alarm signal for a second predetermined period of time longer than said first period of time on initial power-up of the system.

7. An improved precipitator voltage control system as recited in claim 4 and further comprising remote set-point circuit means responsive to a remote control signal and operative to develop a corresponding signal for input to said means for converting so as to cause said drive current signal to track said remote control signal in a predetermined manner.

8. An improved precipitator voltage control system as recited in claim 4 and further comprising power saving circuit means responsive to a scaled secondary current and a scaled secondary voltage of said power transformer and operative to generate a power saving signal for input to said voltage control circuit to cause said secondary current to be reduced to a level whereby the corona curve intersects a line, the slope of which is determined by the ratio of said scaled secondary current to said scaled secondary voltage.

9. An improved precipitator voltage control system as recited in claims 1, 2 or 3 and further comprising remote set-point circuit means responsive to a remote control signal and operative to develop a corresponding signal for input to said means for converting so as to cause drive current signal to track said remote control signal in a predetermined manner.

10. An improved precipitator voltage control system as recited in claims 1, 2 or 3 and further comprising power saving circuit means responsive to a scaled secondary current and a scaled secondary voltage of said power transformer and operative to generate a power saving signal for input to said voltage control circuit to cause said secondary current to be reduced to a level whereby the corona curve intersects a line, the slope of which is determined by the ratio of said scaled secondary current to said scaled secondary voltage.

11. An improved precipitator voltage control system as recited in claim 6 and further comprising remote set-point circuit means responsive to a remote control signal and operative to develop a corresponding signal for input to said means for converting so as to cause said drive current signal to track said remote control signal in a predetermined manner.

12. An improved precipitator voltage control system as recited in claim 9 and further comprising power saving circuit means responsive to a scaled secondary current and a scaled secondary voltage of said power transformer and operative to generate a power saving signal for input to said voltage control circuit to cause said secondary current to be reduced to a level whereby the corona curve intersects a line, the slope of which is determined by the ratio of said scaled secondary current to said scaled secondary voltage.

* * * * *